United States Patent [19]

Pearson

[11] Patent Number: 4,494,672

[45] Date of Patent: Jan. 22, 1985

[54] FLIP TOP CAN COVER

[76] Inventor: Robert E. Pearson, 151 Osceola Dr., New Port Richey, Fla. 33553

[21] Appl. No.: 522,539

[22] Filed: Aug. 12, 1983

[51] Int. Cl.[3] ..... B65D 43/26

[52] U.S. Cl. ..... 220/263; 220/85 H; 220/259

[58] Field of Search ..... 220/85 H, 260, 259, 220/263, 315

[56] References Cited

U.S. PATENT DOCUMENTS

| | | | |
|---|---|---|---|
| 2,016,558 | 10/1935 | Redrup | 220/263 |
| 2,925,190 | 2/1960 | Littleton | 220/263 |
| 3,719,305 | 3/1973 | Pressnell | 220/85 H |

*Primary Examiner*—George T. Hall
*Attorney, Agent, or Firm*—Ronald E. Smith

[57] ABSTRACT

A pivotally mounted closure means for a cylindrical can of the type from which a potable fluid is consumed. A collar member of resilient construction snugly engages the can about its periphery. An ear member projects in a radial direction from the collar member and provides two pivotal mounting means. The first pivotal mounting means is provided at the distal free end of the ear member and the second is spaced radially inwardly therefrom. A deflection plate depending to a closure member pivots about the first pivotal means responsive to deflection thereof by a consumer-actuated lever member that pivots about said second pivotal means.

3 Claims, 3 Drawing Figures

FLIP TOP CAN COVER

BACKGROUND OF THE INVENTION

1. This invention relates generally to closure members, and more specifically relates to closure members of the pivotally mounted type used in conjunction with potable containers.

2. Description of the Prior Art.

A search of United States patents that was conducted prior to the filing of this disclosure found the following patents in the general field of this invention:

| Patentee | U.S. Pat. No. | Date of Issue |
|---|---|---|
| Alonso | 3,229,478 | 01-18-66 |
| Walker | 3,805,989 | 04-23-74 |
| Groendal | 3,905,511 | 09-16-75 |
| Jones | 4,162,740 | 07-31-79 |
| Gerster | 4,205,761 | 06-03-80 |
| Hardt | 4,328,905 | 05-11-82 |

Closure members for containers are ubiquitous. However, as indicated by the results of the search that has been conducted, it is apparent that the art contains no disclosures of a pivotally mounted closure member of the type having utility in the context of a cylindrical container of the type commonly used to contain soft drinks, beer, and other potables.

Both steel and aluminum soft drink cans are in wide use. Typically, the cans are cylindrical members having a disc-like top that is provided with a removable tab to permit consumption of the potable contained therein. The removable tabs may be disposable or nondisposable, depending on whether the tab is removed by the consumer or simply displaced by the consumer. In either event, an opening is provided in the lid of the can so that the consumer may imbibe a liquid.

The tabs which are either removed or simply depressed to provide the needed opening may not be reused as closure members. Thus, once a can has been opened by removal or depression of the tab, the container must be left open during the entire time the potable is being consumed. As a result, dirt, bugs, or other undesirable objects may enter the opening and diminish the delectability of the potable.

An economical to manufacture closure member is clearly needed so that the delectability of the potable may be maintained even after its container has been opened, but such a closure member does not appear in the technical literature.

SUMMARY OF THE INVENTION

The longstanding but heretofore unfulfilled need for a closure member of the type having utility in the context of potable containers for consumers is now provided in the form of a closure member the opening and closing of which is controlled by a novel linkage. The closure member itself is a pivotally mounted disk-like imperforate member that moves between an open position and a closed position responsive to consumer actuation of the novel linkage. A pivotally mounted lever means urges the closure member into its open configuration, upon the depression thereof by a consumer, and the respective pivot points for the closure member and the lever means are formed on an ear member that is carried by a resilient collar that releaseably engages the can.

It is therefore seen that the primary object of this invention is to provide a pivotally mounted closure member for potable containers of the type having opening means that leave the container permanently opened.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figures 1, 2:
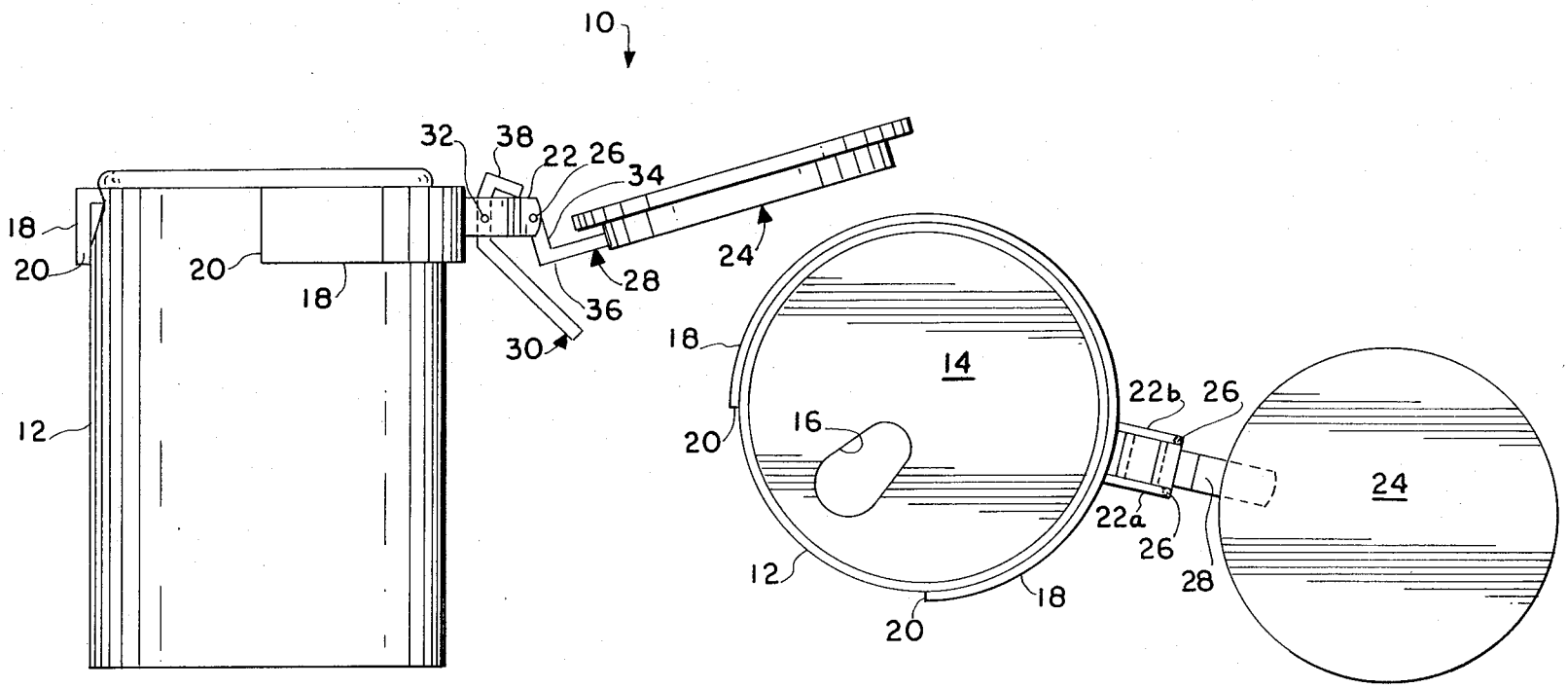
FIG. 1 is a side elevational view of the preferred embodiment of the invention, showing the novel apparatus in its can-attached, open disposition.
FIG. 2 is a top plan, fragmentary view of the invention.

Referring now to FIG. 1, it will there be seen that the environment within which the invention is used is designated by the reference numeral 10 as a whole. The environment 10 includes a cylindrical soft drink or beer can 12 having a lid 14 (FIG. 2) and a weakening line-defined opening 16 formed by the consumer attendant removal of a tab means, not shown.

The inventive closure means includes a resilient, annular in configuration collar member 18 having a cut out portion 20 formed therein, said resiliency and said cut out portion being provided to allow easy attaching and detaching of such collar 18 to the can 12 just downwardly of the lid 14 as shown in FIG. 1, and said cut out portion further enabling the user of the invention to drink from opening 16 without contacting collar 18. Thus, the collar 18 is positioned as shown in FIG. 2 when the invention is in use.

An ear member 22 having spaced parallel arms 22*a* and 22*b* (FIG. 2) is fixedly secured or integrally formed with the collar member 18 and projects therefrom in a horizontal plane, in radial relation to the longitudinal axis of symmetry of the can 12. Closure member 24 is pivotally secured as at 26 to the distal free end of ear 22 as shown in all of the FIGS. More specifically, a rigid "L"-shaped deflection plate member 28 is fixedly secured to, or integrally formed with, and projects radially from the perimeter of closure member 24 and provides the means allowing such member 24 to pivot between its fully closed and its fully opened positions, the latter position being shown in FIGS. 1 and 2.

Figure 3:
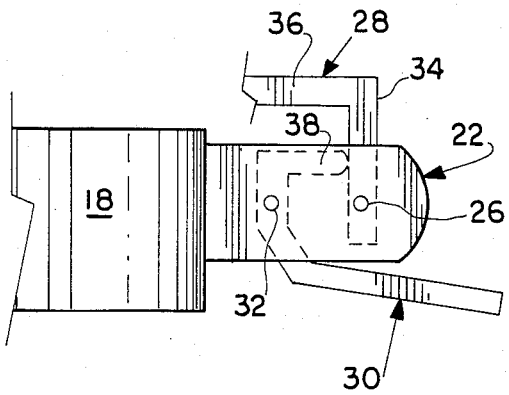
FIG. 3 is a side elevational view of the novel linkage.

The deflection plate 28 is deflected by lever member 30, shown in FIGS. 1 & 3. Lever 30 is pivotally secured, as at 32, to ear member 22. When the closure member 24 is operatively disposed in its opening 16-closing configuration (FIG. 3) portion 34 of link 28 will be disposed in a vertical plane, and portion 36 of link 28 will lie in a horizontal plane. The user of the novel apparatus depresses lever 30 with his or her index finger and portion 38 of lever 30 will deflect plate 28 to displace the closure member 24 about pivot point 26 to expose opening 16 as desired. The closure member is easily manually returned to its closed position, said return again arming the novel linkage so that a subsequent depressing of lever 30 will again expose the opening 16.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. A closure means for a potable container of the type having a tab the removal of which produces a permanent opening in the lid of said container, comprising, in combination, a closure member having a configuration and dimension substantially equal to the configuration and dimension of the lid of said container, a collar member adapted to snugly and releaseably engage said container about its periphery.

an ear member fixedly secured to said collar member in radial relation to the vertical axis of symmetry of said container, a rigid deflection plate member fixedly secured to said closure member and pivotally secured to the distal free end of said ear member, a rigid lever member pivotally secured to said ear member radially inwardly of the distal free end of said ear member, said lever member adapted to abuttingly engage and displace said deflection plate member and hence said closure member attendant pivoting of said lever member about its pivotal mount when said closure member is in its closed disposition.

2. The closure means of claim 1, wherein said deflection plate member is a generally "L"-shaped member having a first leg thereof fixedly secured to and projecting in a common horizontal plane from said closure member and having a second leg thereof bent at a substantially ninety (90) degree angle therefrom, said second leg disposed in a generally vertical plane when said closure member is disposed in its closed configuration and said second leg having a distal free end pivotally secured to the distal free end of said ear member.

3. The closure member of claim 2, wherein said lever member is an elongate member pivotally secured to said ear member substantially midlength of said lever member and having a bend formed therein substantially midlength of said lever member, to define an upper and lower portion thereof, said lower portion adapted to be displaced by a human finger, thereby driving said upper portion into abutting and displacing relation to said deflection plate member when said closure member is in its closed configuration to thereby open the same.

* * * * *